US008550267B2

(12) United States Patent
Lee et al.

(10) Patent No.: US 8,550,267 B2
(45) Date of Patent: Oct. 8, 2013

(54) APPARATUS FOR CABLE MANAGEMENT SYNCHRONIZED WITH TELESCOPIC MOTION

(75) Inventors: Hyo Jik Lee, Daejeon (KR); Kiho Kim, Daejeon (KR); Jong Kwang Lee, Daejeon (KR); Byung-Suk Park, Daejeon (KR); Ho Dong Kim, Daejoen (KR)

(73) Assignees: Korea Atomic Energy Research Institute, Daejeon (KR); Korea Hydro and Nuclear Power Co., Ltd., Seoul (KR)

( * ) Notice: Subject to any disclaimer, the term of this patent is extended or adjusted under 35 U.S.C. 154(b) by 81 days.

(21) Appl. No.: 13/326,440

(22) Filed: Dec. 15, 2011

(65) Prior Publication Data

US 2012/0153091 A1 Jun. 21, 2012

(30) Foreign Application Priority Data

Dec. 16, 2010 (KR) ..... 10-2010-0129159

(51) Int. Cl.
*B66C 17/00* (2006.01)

(52) U.S. Cl.
USPC ..... 212/319; 248/59; 212/321; 212/322; 254/278; 254/283; 254/285

(58) Field of Classification Search
USPC ..... 248/59; 254/285, 900, 278, 283, 336, 254/337; 212/332, 319, 321, 322
See application file for complete search history.

(56) References Cited

U.S. PATENT DOCUMENTS

| | | | | |
|---|---|---|---|---|
| 125,978 | A * | 4/1872 | Neal | 254/285 |
| 516,098 | A * | 3/1894 | Kleritj | 254/285 |
| 894,593 | A * | 7/1908 | Callan | 242/364.11 |
| 1,273,745 | A * | 7/1918 | Currier | 254/286 |
| 1,841,958 | A * | 1/1932 | David et al. | 294/82.16 |

(Continued)

FOREIGN PATENT DOCUMENTS

| | | | |
|---|---|---|---|
| JP | 1980-120677 | U | 8/1980 |
| JP | 1988-041091 | U | 3/1988 |

(Continued)

OTHER PUBLICATIONS

Lee, H.J. et al., "Development of a Bridge Transport System for Remote Handling Tasks at a Nuclear Facility," ICROS (Institute of Control, Robotics and Systems), 2010, pp. 186-188.

(Continued)

*Primary Examiner* — Terrell McKinnon
*Assistant Examiner* — Daniel J Breslin
(74) *Attorney, Agent, or Firm* — Fredrikson & Byron, PA

(57) ABSTRACT

Disclosed herein is an apparatus for cable management synchronized with telescopic motion. The apparatus is configured such that cables for transmitting power or signals to a manipulator provided on a lower end of a telescopic tube and for receiving signals therefrom are wound or unwound in response to expansion or contraction of the telescopic tube. Moreover, the apparatus is configured such that the cables are prevented from being displaced from the correct positions, a noise is prevented from being generated, and the tension of each cable is adjusted even when it is in the clamped state.

5 Claims, 12 Drawing Sheets

(56) References Cited

U.S. PATENT DOCUMENTS

| | | | | | |
|---|---|---|---|---|---|
| 2,157,887 | A * | 5/1939 | Davis | 137/355.17 |
| 3,771,666 | A * | 11/1973 | Fournier | 414/591 |
| 3,776,519 | A * | 12/1973 | Hamilton | 254/311 |
| 3,887,080 | A * | 6/1975 | Wilson | 212/318 |
| 4,337,924 | A * | 7/1982 | Gebo | 254/134.3 R |
| 4,715,762 | A * | 12/1987 | Lanigan et al. | 414/798.1 |
| 5,117,859 | A * | 6/1992 | Carlson | 137/355.25 |
| 5,465,854 | A | 11/1995 | Sturm et al. | |
| 5,499,774 | A * | 3/1996 | Novak et al. | 242/364.2 |
| 5,762,279 | A * | 6/1998 | Horton, III | 254/285 |
| 6,244,991 | B1 * | 6/2001 | Bingham | 482/69 |
| 6,561,368 | B1 | 5/2003 | Sturm, Jr. et al. | |
| 6,595,494 | B1 * | 7/2003 | Roodenburg et al. | 254/277 |
| 6,926,103 | B1 * | 8/2005 | Roodenburg et al. | 175/203 |
| 6,926,259 | B1 * | 8/2005 | Roodenburg et al. | 254/277 |
| 7,604,134 | B2 * | 10/2009 | Lichinchi | 212/175 |
| 7,617,840 | B1 * | 11/2009 | Zinda | 137/355.23 |
| 7,624,967 | B1 * | 12/2009 | Doebler et al. | 254/272 |
| 2006/0180564 | A1 * | 8/2006 | Keppel | 212/330 |
| 2006/0231812 | A1 * | 10/2006 | Ziech et al. | 254/278 |

FOREIGN PATENT DOCUMENTS

| | | | |
|---|---|---|---|
| JP | 1994-010274 | U | 2/1994 |
| JP | 1995061768 | A | 3/1995 |
| JP | 3279992 | B2 | 11/1997 |
| JP | 1998001296 | A | 1/1998 |
| JP | 2566346 | Y2 | 3/1998 |
| JP | 2008531231 | A | 8/2008 |

OTHER PUBLICATIONS

Lee, H.J. et al., "Development of a Bridge Transport System with Telescopic Motion," 1st International Conference on Applied Robotics for the power Industry, 2010.

Yoon, K.H. et al., "Design of Bridge Transport System with Equal Incremental Telescopic Motion," Transaction of KSME A, 2010, vol. 34(2), pp. 227-235.

Lee, H.J. et al., "Development of an Overlead Crane for Remote Handling Tasks at Nuclear Facility," International Conference on Control, Automation and Systems, 2010, pp. 1830-1834.

* cited by examiner

APPARATUS FOR CABLE MANAGEMENT SYNCHRONIZED WITH TELESCOPIC MOTION

CROSS-REFERENCES TO RELATED APPLICATION

This patent application claims the benefit of priority from Korean Patent Application No. 10-2010-0129159, filed on Dec. 16, 2010, the contents of which are incorporated herein by reference.

BACKGROUND OF THE INVENTION

1. Field of the Invention

The present invention relates to an apparatus for cable management synchronized with telescopic motion, which can effectively manage cables for transmitting power and signals to a manipulator provided on a telescopic tube of a ceiling-mounted transfer apparatus.

2. Description of the Related Art

Generally, ceiling-mounted transfer apparatuses including telescopic tubes are mounted to a ceiling to efficiently manage a dual arm servo-manipulator which remote-operates and maintains pyroprocessing equipment in a cell. Transferring the dual arm servo-manipulator to a desired working area in the cell is the crucial function of the ceiling-mounted transfer apparatuses.

As shown in FIGS. 1 and 2, in such a ceiling-mounted transfer apparatus, a rail is installed on the ceiling. A girder 1 is provided on the rail so as to be movable along the rail. A trolley box 2 is provided on the girder 1 so as to be movable in a direction perpendicular to the direction in which the girder 1 moves.

A telescopic tube 3 is provided under the trolley box 2 and configured such that it can expand and contract vertically. A manipulator 4 is mounted to the lower end of the telescopic tube 3.

Power and electric signals for operating and controlling the manipulator 4 are transmitted to the manipulator 4 by cables 5. The cables 5 extend from the manipulator 4 upwards along the interior of the telescopic tube 3. It has been necessary to effectively manage the cables 5 in response to expansion and contraction of the telescopic tube.

SUMMARY OF THE INVENTION

Accordingly, the present invention has been made keeping in mind the above problems occurring in the prior art, and an object of the present invention is to provide an apparatus for cable management synchronized with telescopic motion, which can effectively manage cables for transmitting power and signals to a manipulator provided on a telescopic tube of a ceiling-mounted transfer apparatus.

In order to accomplish the above object, the present invention provides an apparatus for cable management synchronized with telescopic motion such that cables for transmitting power or signals to a manipulator provided on a lower end of a telescopic tube and for receiving signals therefrom are wound or unwound in response to expansion or contraction of the telescopic tube, the apparatus including: a frame installed in a trolley box, with the telescopic tube fastened at an upper end thereof to the trolley box; a stationary cable drum provided in an upper end of the frame, with the cables extending from the manipulator to the stationary cable drum and wrapping around the stationary cable drum; a movable cable drum provided below the stationary cable drum so as to be movable upwards or downwards, with the cables extending from the stationary cable drum to the movable cable drum and wrapping around the movable cable drum; and a vertical guide roller provided in the frame at a position spaced apart from the stationary cable drum in a horizontal direction by a predetermined distance, the vertical guide roller supporting and guiding the cables towards the stationary cable drum in such a way that the cables extending from the manipulator is wrapped around the vertical guide roller. The stationary cable drum, the movable cable drum and the vertical guide roller each include a plurality of pulleys supported by a support shaft passing through central holes of the pulleys, each of the pulleys being inclined to the support shaft at a predetermined angle.

Furthermore, a collar may be provided between each of the pulleys and the support shaft. The collar may be forcibly fitted at a central hole thereof over the support shaft. A bearing may be provided between a circumferential outer surface of the collar and a circumferential inner surface of the pulley to allow the pulley to rotate around the collar.

The stationary cable drum, the movable cable drum and the vertical guide roller each may be configured such that an angle of the central hole of each of the collars to the support shaft is increased from the pulley disposed at a first side to the pulley disposed at a second side.

In addition, the number of pulleys provided on each of the stationary cable drum and the movable cable drum may be twice as many as the number of pulleys provided on the vertical guide roller.

The apparatus may further include: a tension adjusting unit holding ends of the cables that wrap over the movable cable drum and extend upwards, the tension adjusting unit controlling tensions of the cables. The tension adjusting unit may include: a support member fastened to the trolley box or the frame, with bolt holes formed vertically through the support member; bolt members threaded into the corresponding bolt holes of the support member, each of the bolt members having a cable hole formed longitudinally therethrough, with a head provided on an upper end of each of the bolt members, the head being configured such that the cable hole is partially open on the head; and an adjustment block coupled to the head of each of the bolt members by a screw, the adjustment block compressing the end of the corresponding cable, which is exposed out of the open portion of the head, towards the head of the bolt member, thus clamping the end of the cable.

The apparatus may include an auxiliary guide roller provided in the frame at a position opposing the vertical guide roller based on the stationary cable drum, the auxiliary guide roller preventing the cables wrapped over the stationary cable drum and the movable cable drum from being displaced therefrom.

The tension adjusting unit may include: nut members threaded over the respective bolt members on a top plate of the support member, each of the nut members rotating in a direction so that the corresponding bolt member is moved upwards or downwards; and fastening blocks coupled to a lower surface of the top plate of the support member by screws, each of the fastening blocks compressing a portion of the corresponding bolt member, which is exposed out of the corresponding bolt hole, towards the support member, thus fastening the bolt member to the support member.

In an apparatus for cable management synchronized with telescopic motion according to the present invention, cables for transmitting power or signals to a manipulator provided on a lower end of a telescopic tube or for receiving signals therefrom are wound or unwound in response to expansion or contraction of the telescopic tube. Therefore, the present invention can efficiently manage the cables in a comparatively small space.

Furthermore, the cables wrap over the pulleys such that the cables run parallel to the grooves of the pulleys, thus preventing the cables from being displaced from the correct paths, and reducing friction between the pulleys and the cables so that a noise is prevented from being generated.

Moreover, the present invention is configured such that the tension of each cable can be adjusted even when it is in the clamped state. Therefore, the tensions of the cables can always be maintained constant, thus reliably keeping the cables wrapped over the pulleys, thereby preventing the cables from being displaced from the pulleys.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, preferred embodiments of the present invention will be described in detail with reference to the attached drawings.

Figure 1:
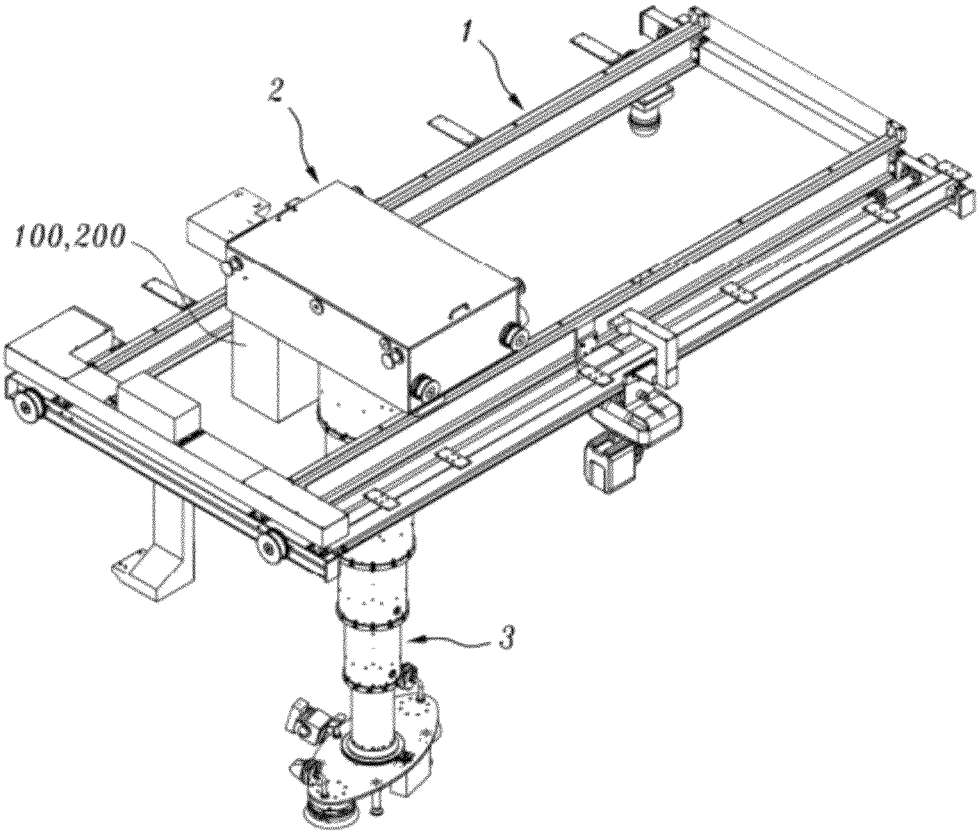
FIG. 1 is a perspective view illustrating an apparatus for cable management synchronized with telescopic motion which is assembled with a ceiling-mounted transfer apparatus, according to a preferred embodiment of the present invention.
Figure 2A:
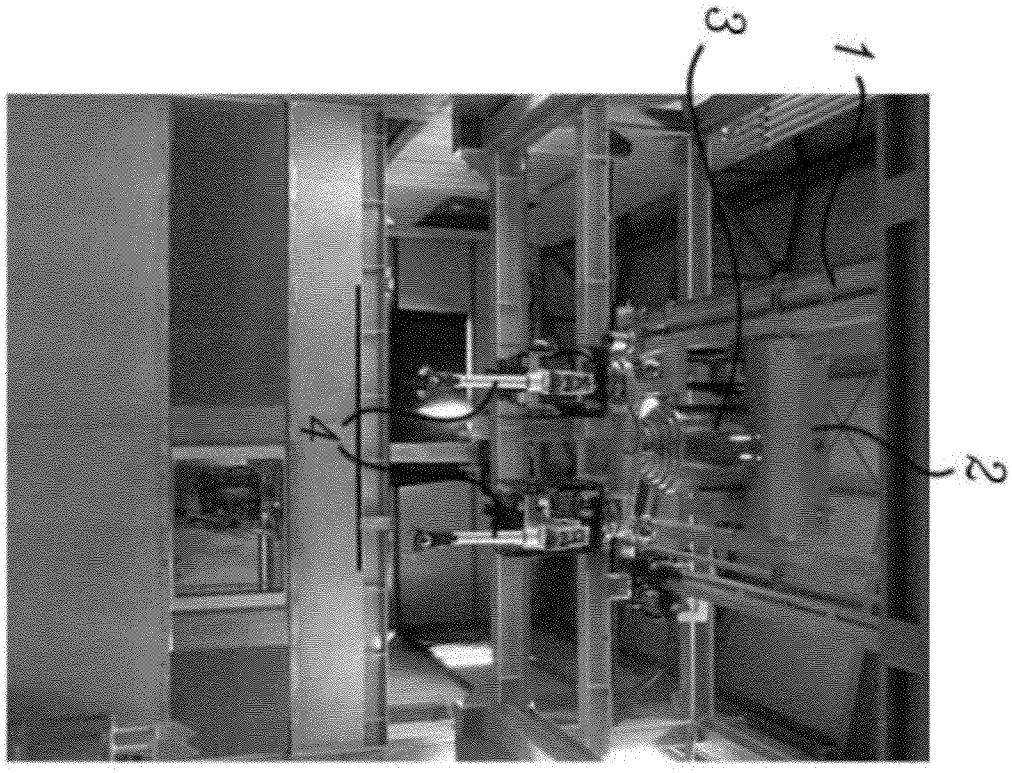
FIG. 2A illustrates a contracted state of a telescopic tube of the ceiling-mounted transfer apparatus of FIG. 1.
Figure 2B:
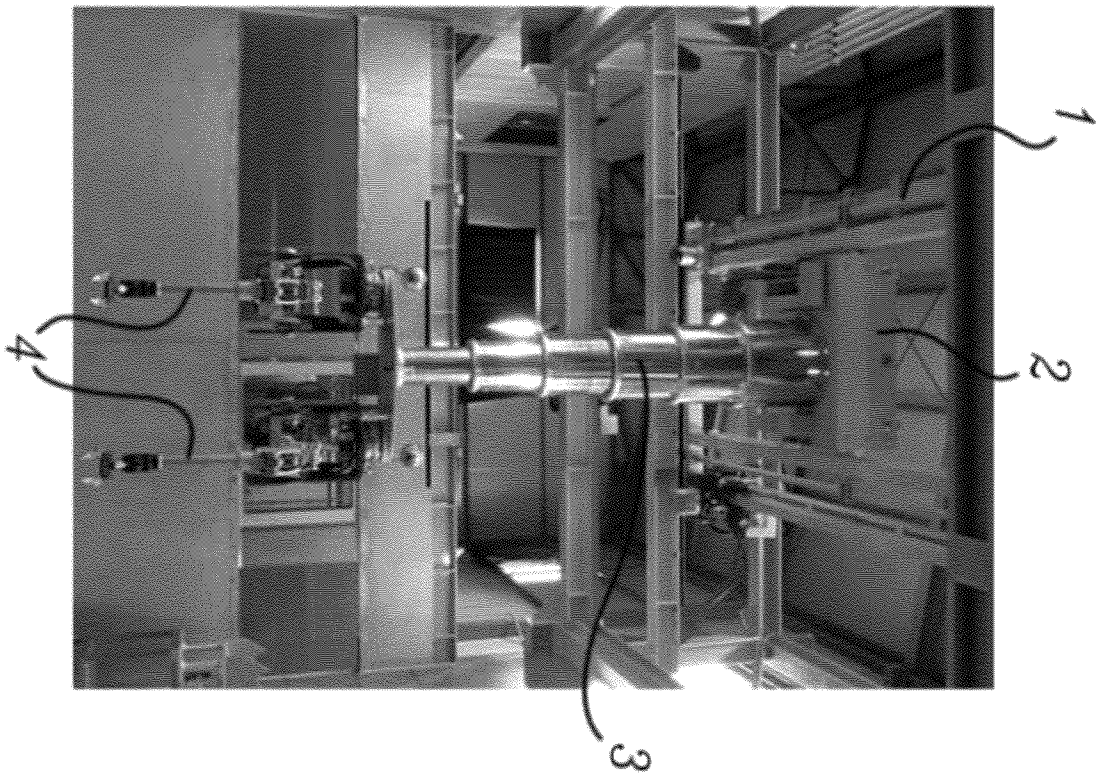
FIG. 2B illustrates an expanded state of the telescopic tube of FIG. 2A.

FIG. 1 is a perspective view illustrating an apparatus for cable management synchronized with telescopic motion which is assembled with a ceiling-mounted transfer apparatus, according to a preferred embodiment of the present invention. FIG. 2A illustrates a contracted state of a telescopic tube of the ceiling-mounted transfer apparatus of FIG. 1. FIG. 2B illustrates an expanded state of the telescopic tube of FIG. 2A.

Figure 3:
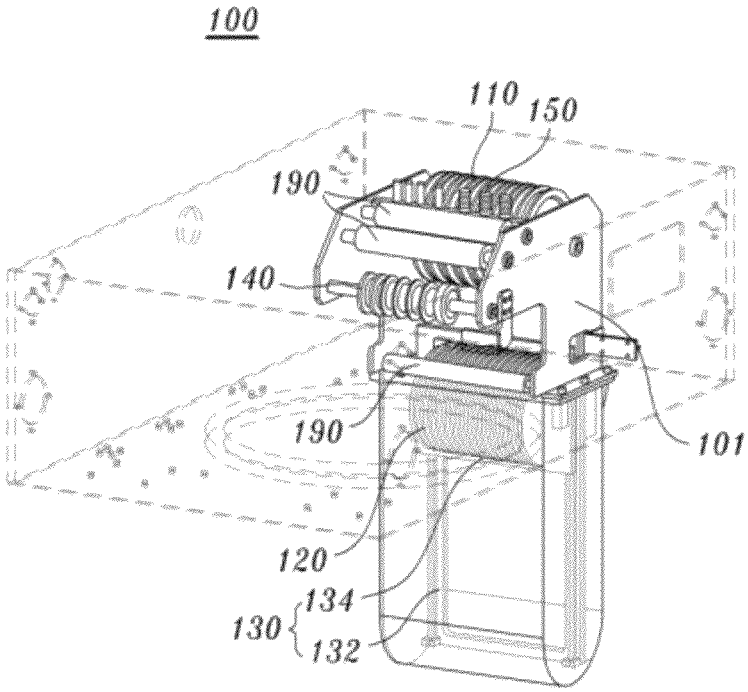
FIGS. 3 and 4 are perspective views illustrating an apparatus for cable management synchronized with telescopic motion, according to a first embodiment of the present invention.
Figure 4:
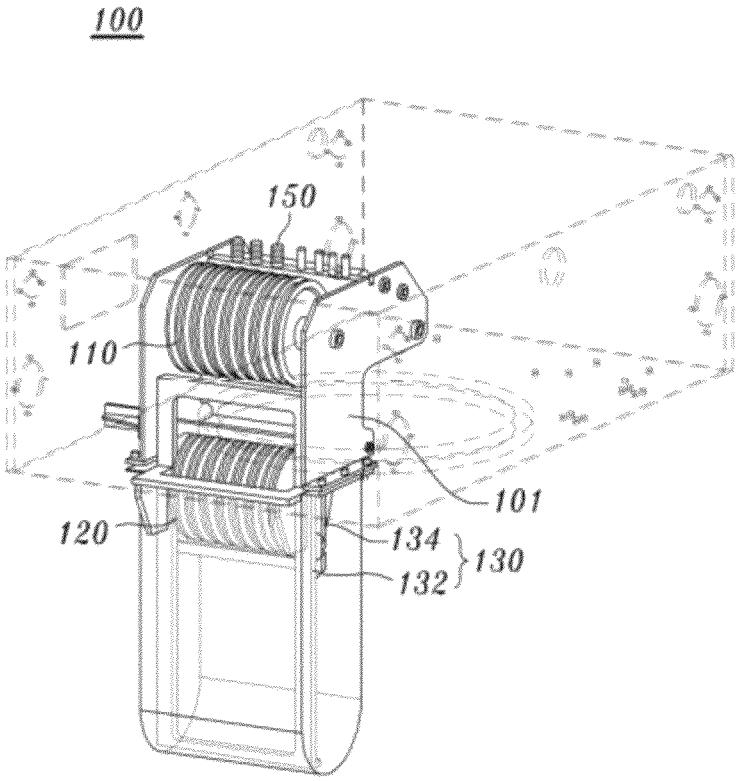

FIGS. 3 and 4 are perspective views illustrating an apparatus for cable management synchronized with telescopic motion, according to a first embodiment of the present invention.

The cable management apparatus 100 according to the present invention is configured such that cables 5 for transmitting power or signals to a manipulator 4 provided on a lower end of the telescopic tube 3 or for receiving signals therefrom are wound or unwound in response to expansion or contraction of the telescopic tube 3.

In detail, the cable management apparatus 100 includes a frame 101 which is mounted to a trolley box 2 to which the upper end of the telescopic tube 3 is fastened, and a stationary cable drum 110 and a movable cable drum 120 which are installed in the frame 101.

The stationary cable drum 110 is provided in the upper end of the frame 101. The cables 5 which extend upwards from the manipulator 4 disposed below are wrapped over the stationary cable drum 110.

The cables 5 that extend from the stationary cable drum 110 are wrapped over the movable cable drum 120. The movable cable drum 120 is provided in the frame 101 below the stationary cable drum 110 so as to be movable vertically.

An LM guide 130 is provided in the frame 101 to embody the vertical movement of the movable cable drum 120.

The LM guide 130 includes an LM rail 132 which is provided in a lower portion of the frame 101 and extends a predetermined length vertically, and an LM block 134 which moves along the LM rail 132.

The movable cable drum 120 is coupled to the LM block 134 so that as the LM block 134 moves along the LM rail 132 vertically, the movable cable drum 120 can smoothly move vertically under the guidance of the LM guide 130.

Meanwhile, the cable management apparatus 100 may further include a vertical guide roller 140 which is spaced apart from the stationary cable drum 110.

The vertical guide roller 140 is installed in the frame 101 at a position spaced apart from the stationary cable drum 110 in the horizontal direction by a predetermined distance.

The vertical guide roller 140 guides the cables 5 such that the cables 5 that extend upwards from the manipulator 4 disposed below the apparatus 100 run to the stationary cable drum 110 via the vertical guide roller 140. In other words, the cables 5 that extend upwards from the manipulator 4 are guided and bent by the vertical guide roller 140 towards the stationary cable drum 110 before they are wound around the stationary cable drum 110.

The present invention further includes horizontal guide rollers 150 which are disposed between the vertical guide roller 140 and the stationary cable drum 110. The horizontal guide rollers 150 guide the cables 5 that run from the vertical guide roller 140 to the stationary cable drum 110, so that the cables 5 are smoothly connected to the stationary cable drum 110.

The present invention further includes idle rollers 190 which are installed in the frame 101 below the vertical guide roller 140 and between the vertical guide roller 140 and the horizontal guide rollers 150. The idle rollers 190 function to reliably support and guide the cables 5.

In the cable management apparatus 100 having the above-mentioned construction, the movable cable drum 120 moves upwards or downwards depending on the expansion or contraction of the telescopic tube 3, thus facilitating the management of winding or unwinding the cables 5.

In this embodiment, a total six pieces of cables 5 are provided. The six pieces of cables 5 run upwards from the telescopic tube 3 and first pass over the vertical guide roller 140.

The cables 5 that pass over the vertical guide roller 140 go to the stationary cable drum 110 via the horizontal guide rollers 150, wrap around the stationary cable drum 110 to 90°, extend from the stationary cable drum 110 vertically-downwards, wrap around the movable cable drum 120 to 180°, and then extend from the movable cable drum 120 vertically-upwards.

Subsequently, the cables 5 wrap around the stationary cable drum 110, extend vertically-downwards again, wrap around the movable cable drum 120 to 180° again, extend from the movable cable drum 120 vertically-upwards, and then are connected to a terminal block of the trolley box 2.

As such, the cables 5 are wound twice around each of the stationary cable drum 110 and the movable cable drum 120. Therefore, the stationary cable drum 110 and the movable cable drum 120 each have twelve pulleys 250. Thanks to the double winding structure, the distance that the movable cable drum 120 needs to move is only ¼ of the distance that the telescopic tube 3 expands or contracts.

Figure 5:
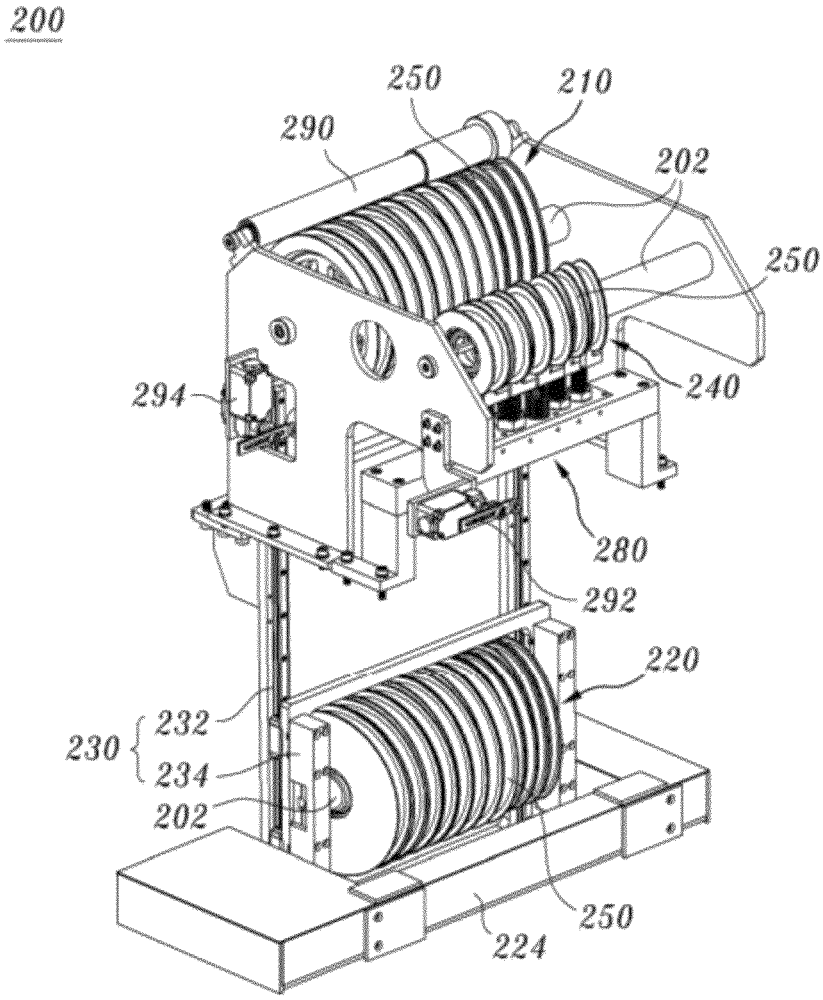
FIGS. 5 and 6 are perspective views illustrating an apparatus for cable management synchronized with telescopic motion, according to a second embodiment of the present invention.
Figure 6:
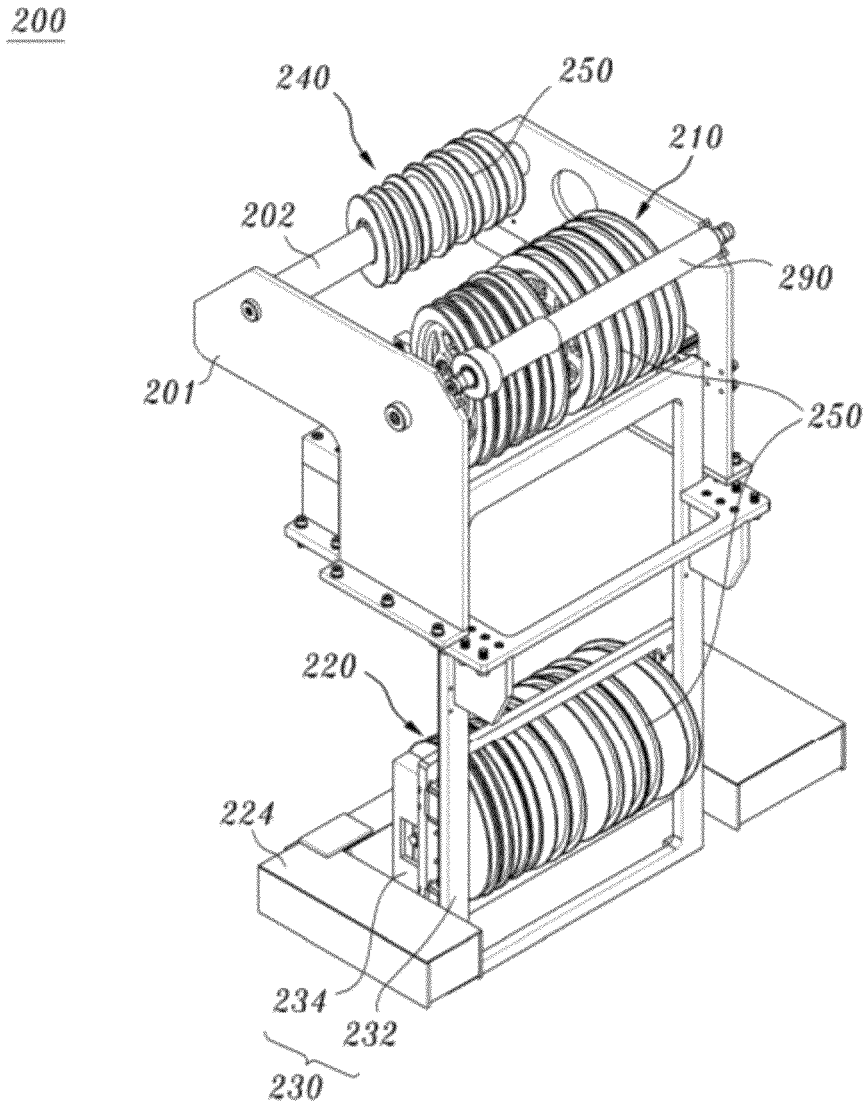
Figure 7:
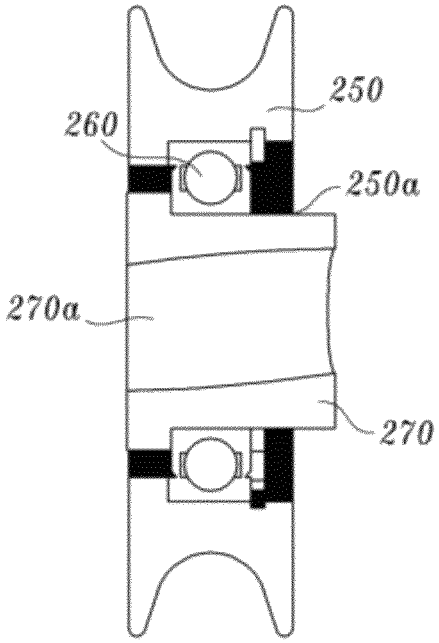
FIG. 7 is a longitudinal sectional view of a pulley of the cable management apparatus of FIG. 5.

FIGS. 5 and 6 are perspective views illustrating an apparatus for cable management synchronized with telescopic motion, according to a second embodiment of the present invention. FIG. 7 is a longitudinal sectional view of a pulley 250 of the cable management apparatus of FIG. 5.

Figure 8:
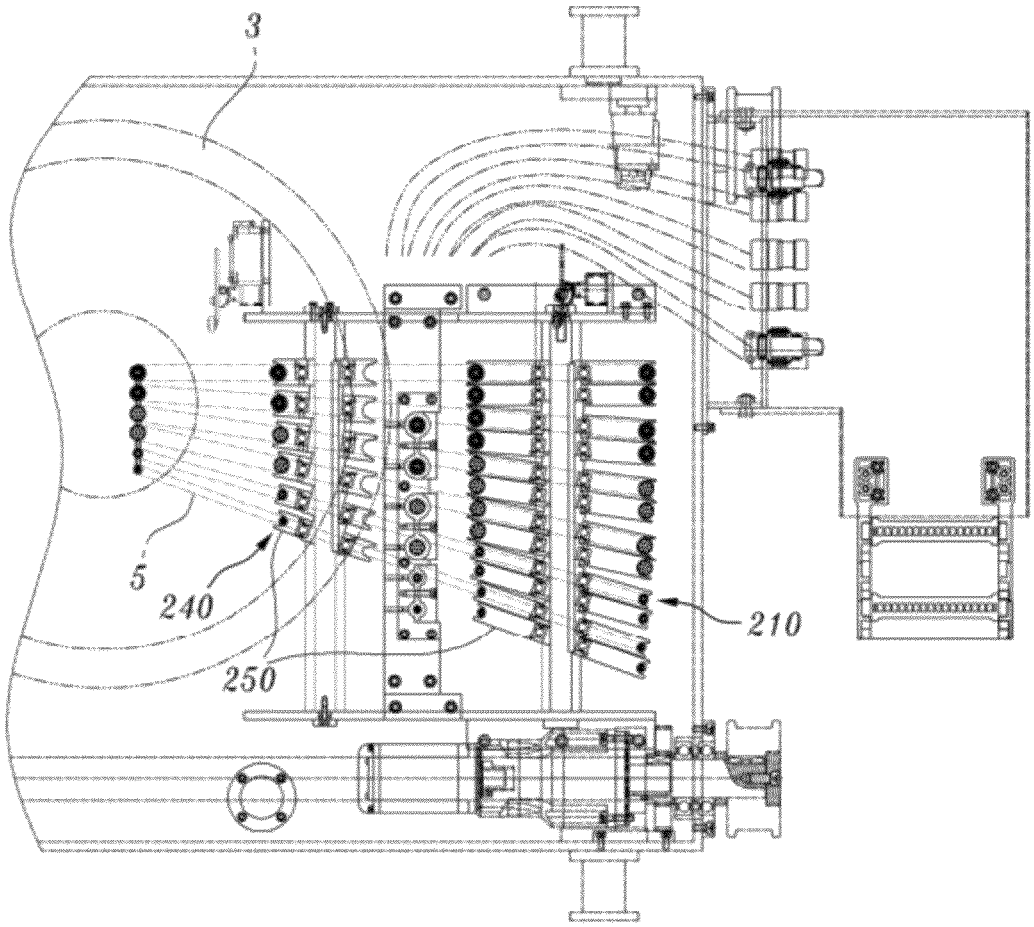
FIG. 8 is a plan view illustrating the cable management apparatus of FIG. 5.
Figure 9:
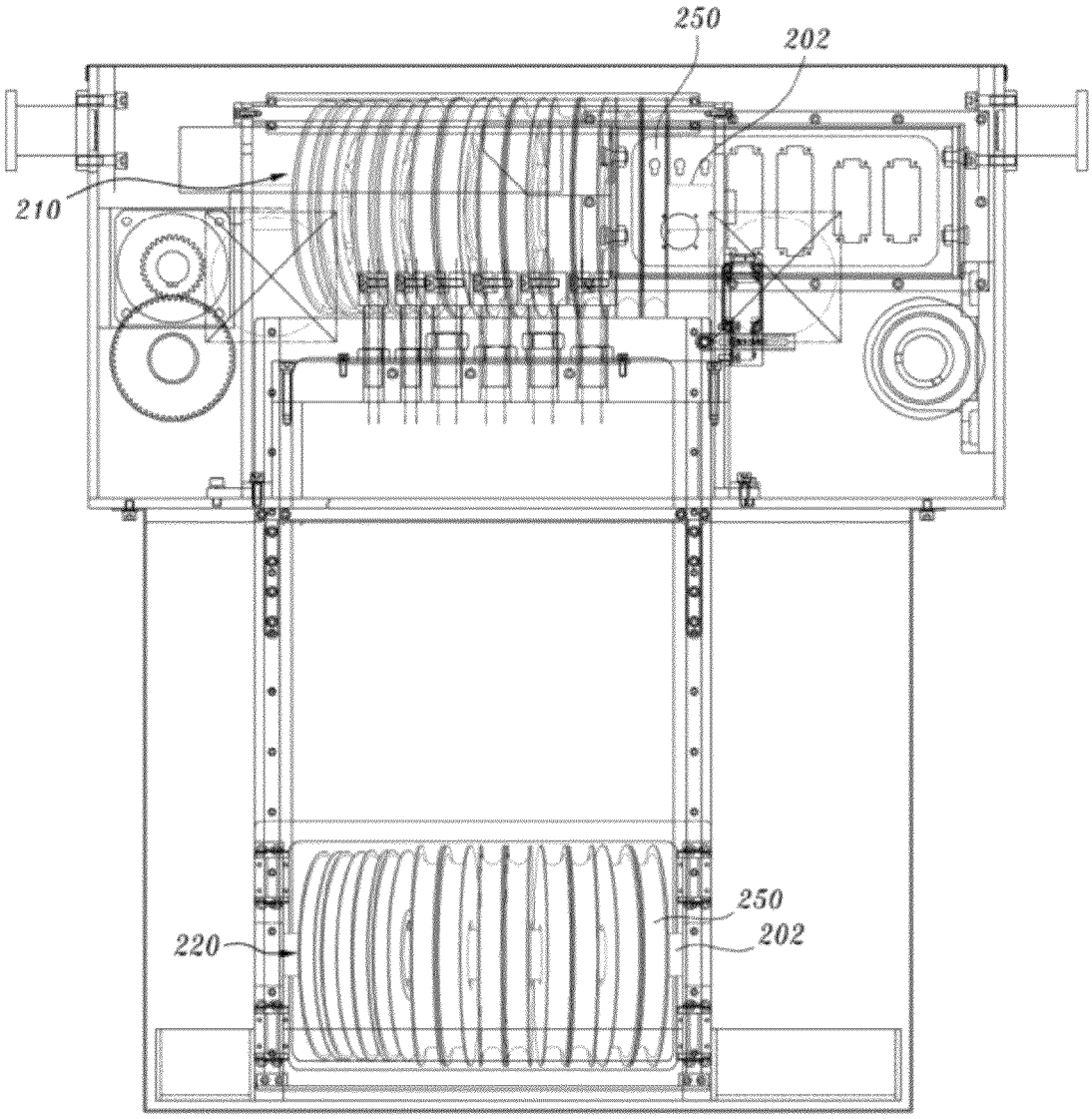
FIG. 9 is a side view illustrating the cable management apparatus of FIG. 8.

FIG. 8 is a plan view illustrating the cable management apparatus of FIG. 5. FIG. 9 is a side view illustrating the cable management apparatus of FIG. 8.

Referring to the drawings, the cable management apparatus 200 according to the second embodiment of the present invention is configured such that each cable 5 wraps around the corresponding pulley 250 and runs parallel to the pulley 250 along a groove of the pulley 250, thus reducing friction between the cable 5 and the pulley 250. In addition, the cable management apparatus 200 is configured so that the tension of the cables 5 can be adjusted while the cables 5 are being clamped.

In detail, the cable management apparatus 200 includes a frame 201 which is mounted to the trolley box 2 to which the upper end of the telescopic tube 3 is fastened, and a stationary cable drum 210, a movable cable drum 220 and a vertical guide roller 240 which are installed in the frame 201. Further, an LM guide 230 is installed in the frame 201 to allow the movable cable drum 220 to move vertically.

The detailed explanation of the structures of the above elements and the arrangement structure of the cables 5 wound around the elements will be omitted because they have been described above.

Meanwhile, the stationary cable drum 210, the movable cable drum 220 and the vertical guide roller 240 each have a plurality of pulleys 250.

In this embodiment, support shafts 202 are installed in and fastened at both ends thereof to the frame 201. Each support shaft 202 is inserted into central holes 250*a* of the corresponding pulleys 250 so that the pulleys 250 can be installed in the frame 201.

A collar 270 is disposed between each pulley 250 and the support shaft 202. The support shaft 202 is forcibly fitted into a central hole 270*a* of the collar 270 so that collar 270 can be fastened to the support shaft 202.

Furthermore, a bearing 260 is provided around the circumferential inner surface of each pulley 250. The bearing 260 comes into contact with the circumferential outer surface of the corresponding collar 270 and slides around it so that the pulley 250 can smoothly rotate.

The farther the position at which each cable 5 runs over the corresponding pulley 250 is from the pulley 250 disposed at a first end of the vertical guide roller 240 to the pulley 250 disposed at a second end thereof, the more the cables 5 which extend upwards from the lower end of the telescopic tube 3 and run over the pulleys 250 are inclined from the direction perpendicular to the support shaft 202.

In other words, as shown in FIG. 8, the cables 5 which transmit power and electric signals to the manipulator 4 are arranged such that they extend upwards from the manipulator 4 along an interior hole of the telescopic tube 3. The angle of each cable 5 to the direction perpendicular to the support shaft 202 fitted into the vertical guide roller 240 is increased from the first end of the support shaft 202 to the second end thereof.

If the cable 5 which runs along the groove of the pulley 250 is inclined with respect to the groove of the pulley 250 rather than being parallel to the groove, the cable 5 may be removed out of the groove of the pulley 250, or noise may be generated by friction between the pulley 250 and the cable 5 when the pulley 250 rotates.

To prevent the above problems, the collars 270 of the stationary cable drum 210, the movable cable drum 220 and the vertical guide roller 240 are configured such that the angle at which the central hole 270*a* of each collar 270 is inclined with respect to the collar 270 is gradually increased from the first end of the support shaft 270 to the second end thereof, thus making the cables 5 parallel to the grooves of the corresponding pulleys 250.

The material of each pulley 250 is Teflon so that friction between the pulley 250 and the corresponding cable 5 can be reduced, thus preventing the cable 5 from becoming worn.

Figure 10:
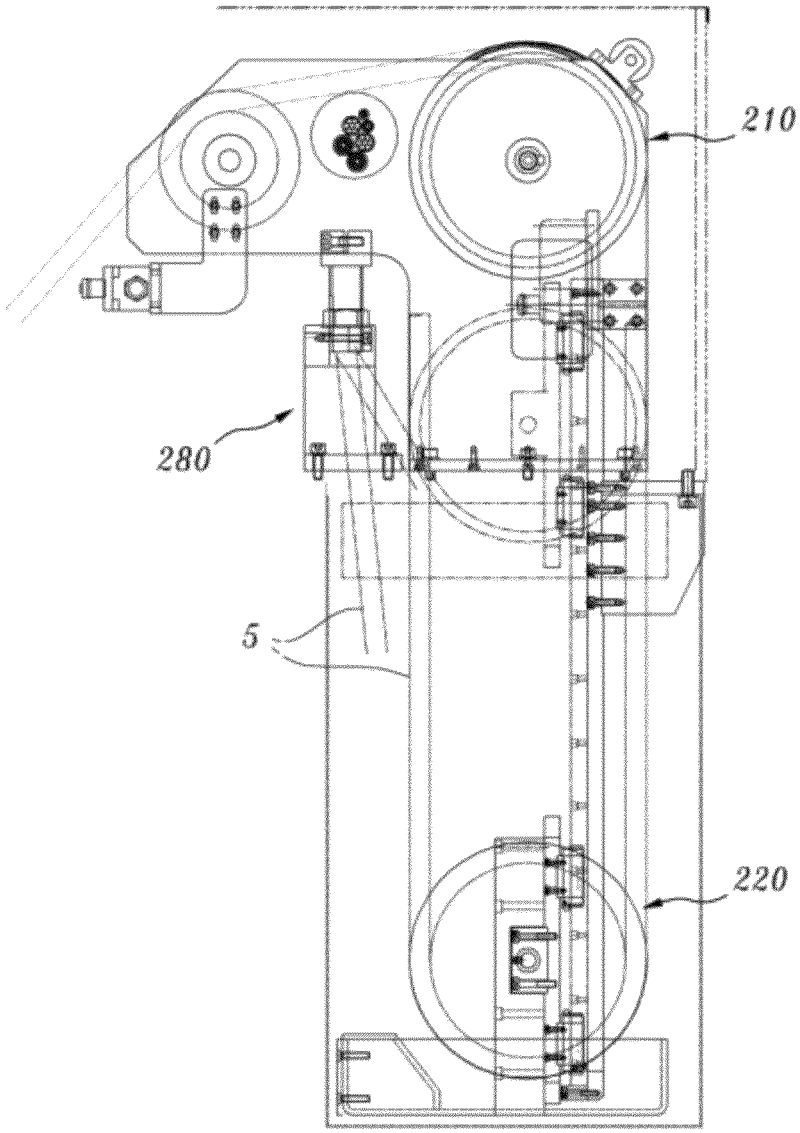
FIG. 10 is a front view illustrating pulleys of the cable management apparatus of FIG. 8.
Figure 11:
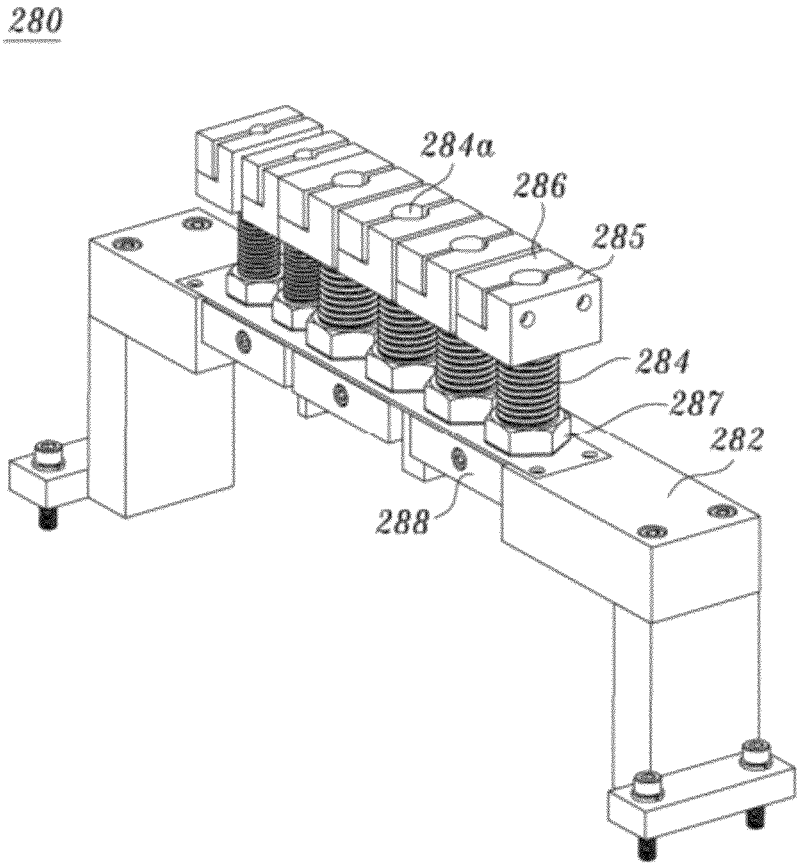
FIG. 11 is a perspective view illustrating a tension adjusting unit of FIG. 10.

FIG. 10 is a front view illustrating the pulleys of the cable management apparatus of FIG. 8. FIG. 11 is a perspective view illustrating a tension adjusting unit of FIG. 10.

Referring to the drawings, the cable management apparatus 200 may further include the tension adjusting unit 280. The tension adjusting unit 280 functions to hold the ends of the cables 5 that wrap around the movable cable drum 220 and extend upwards, and to control the tension of each cable 5.

The tension adjusting unit 280 includes a support member 282 which is fastened to the trolley box 2 or the frame 201, and bolt members 284 and adjustment blocks 286 which are mounted to the support member 282.

The support member 282 has a plurality of bolt holes (not shown) which are formed vertically.

The bolt members 284 are threaded into the corresponding bolt holes of the support member 282. A cable hole 284*a* is longitudinally formed through each bolt member 284.

A head 285 is provided on an upper end of each bolt member 284. The head 285 is configured such that portion of the cable hole 284*a* is open thereon.

Each adjustment block 286 is coupled to the head 285 of the corresponding bolt member 284 by a screw.

The adjustment block 286 is configured such that as the adjustment block 286 moves towards the head 285 of the bolt member 284, it compresses the cable 5, which is exposed out of the open cable hole 284*a*, onto the head 285 of the bolt member 284, thus reliably holding the cable 5.

In detail, the shape of the head 285 of the bolt member 284 is an L shape. As the adjustment block 286 moves towards the inside of the bolt member 284 and reduces the space of the L-shaped head 285, the force of compressing the cable 5 between the adjustment block 286 and the head 285 increases. Thereby, the cable 5 can be reliably held between the adjustment block 286 and the head 285.

The support member 282 is configured such that each bolt hole into which the corresponding bolt member 284 is inserted is partially open.

The tension adjusting unit 280 further includes nut members 287 which are threaded over the corresponding bolt members 284 on the upper surface of the support member 282. As each nut member 287 rotates in a direction, the bolt member 284 is moved upwards or downwards along the bolt hole of the support member 282, thus finely adjusting the tension of the corresponding cable 5.

Furthermore, the support member 282 is configured such that the bolt holes into which the bolt members 284 are threaded are partially open. Fastening blocks 288 are coupled to the open portions of the bolt holes.

The fastening blocks 288 are coupled to the support member 282 by screws. Each fastening block 288 compresses the portion of the corresponding bolt member 284, which is exposed out of the open bolt hole, onto the support member 282. Thereby, the bolt member 284 which has moved upwards or downwards and adjusted the tension of the cable 5 can be reliably fastened to the support member 282.

Meanwhile, the cable management apparatus 200 further includes an auxiliary guide roller 290 which is provided in the frame 201 at a position that opposes the vertical guide roller 240 based on the stationary cable drum 210.

The auxiliary guide roller 290 functions to prevent the cables 5 that wrap over the stationary cable drum 210 and the movable cable drum 220 from being displaced therefrom.

Further, a first limit switch 292 and a second limit switch 294 are provided on the frame 201. The first limit switch 292 is operated in such a way that a bar provided on the telescopic tube 3 moves upwards and pushes the first limit switch 292 when the telescopic tube 3 is completely contracted. The second limit switch 294 is operated in such a way that when the telescopic tube 3 is maximally expanded, the movable cable drum 220 moves upwards and pushes the second limit switch 294.

Preferably, the LM block 234 of the LM guide 230 is provided with a weight 224 so that the movable cable drum 220 is moved downwards by its own weight while the telescopic tube 3 is contracted.

The present invention having the above-mentioned construction is configured such that the cables 5 for transmitting power or signals to the manipulator 4 provided on the lower end of the telescopic tube 3 or for receiving signals therefrom are wound or unwound in response to expansion or contraction of the telescopic tube 3. Therefore, the present invention can efficiently manage the cables 5 in a comparatively small amount of space.

Furthermore, the cables 5 wrap over the pulleys 250 such that the cables 5 run parallel to the grooves of the pulleys 250, thus preventing the cables 5 from being displaced from their correct paths, and reducing friction between the pulleys 250 and the cables 5 so that a noise is prevented from being generated.

Moreover, the present invention is configured such that the tension of each cable 5 can be adjusted even when it is in the clamped state. Therefore, the tensions of the cables 5 can be always maintained constant, thus reliably keeping the cables 5 wrapping over the pulleys 250, thereby preventing the cables 5 from being displaced from the pulleys 250.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for cable management synchronized with telescopic motion such that cables for transmitting power or signals to a manipulator provided on a lower end of a telescopic tube and for receiving signals therefrom are wound or unwound in response to expansion or contraction of the telescopic tube, the apparatus comprising:

a frame installed in a trolley box, with the telescopic tube fastened at an upper end thereof to the trolley box;

a stationary cable drum provided in an upper end of the frame, with the cables extending from the manipulator to the stationary cable drum and wrapping around the stationary cable drum;

a movable cable drum provided below the stationary cable drum so as to be movable upwards or downwards, with the cables extending from the stationary cable drum to the movable cable drum and wrapping around the movable cable drum;

a vertical guide roller provided in the frame at a position spaced apart from the stationary cable drum in a horizontal direction by a predetermined distance, the vertical guide roller supporting and guiding the cables towards the stationary cable drum in such a way that the cables extending from the manipulator are wrapped around the vertical guide roller, wherein the stationary cable drum, the movable cable drum and the vertical guide roller each comprise a plurality of pulleys supported by a support shaft passing through central holes of the pulleys, each of the pulleys being inclined to the support shaft at a predetermined angle; and a collar provided between each of the pulleys and the support shaft, the collar being forcibly fitted at a central hole thereof over the support shaft, and a bearing provided between a circumferential outer surface of the collar and a circumferential inner surface of the pulley to allow the pulley to rotate around the collar.

2. The apparatus as set forth in claim 1, wherein the stationary cable drum, the movable cable drum and the vertical guide roller each are configured such that an angle of the central hole of each of the collars to the support shaft is increased from the pulley disposed at a first side to the pulley disposed at a second side.

3. The apparatus as set forth in claim 1, wherein a number of pulleys provided on each of the stationary cable drum and the movable cable drum is twice as many as a number of pulleys provided on the vertical guide roller.

4. The apparatus as set forth in claim 1, further comprising:

a tension adjusting unit holding ends of the cables that wrap over the movable cable drum and extend upwards, the tension adjusting unit controlling tensions of the cables, the tension adjusting unit comprising:

a support member fastened to the trolley box or the frame, with bolt holes formed vertically through the support member;

bolt members threaded into the corresponding bolt holes of the support member, each of the bolt members having a cable hole formed longitudinally therethrough, with a head provided on an upper end of each of the bolt members, the head being configured such that the cable hole is partially open on the head; and an adjustment block coupled to the head of each of the bolt members by a screw, the adjustment block compressing the end of the corresponding cable, which is exposed out of the open portion of the head, towards the head of the bolt member, thus clamping the end of the cable.

5. The apparatus as set forth in claim 4, wherein the tension adjusting unit comprises:

nut members threaded over the respective bolt members on a top plate of the support member, each of the nut members rotating in a direction so that the corresponding bolt member is moved upwards or downwards; and fastening blocks coupled to a lower surface of the top plate of the support member by screws, each of the fastening blocks compressing a portion of the corresponding bolt member, which is exposed out of the corresponding bolt hole, towards the support member, thus fastening the bolt member to the support member.

* * * * *